United States Patent [19]

Miavecz et al.

[11] 3,976,912

[45] Aug. 24, 1976

[54] ELECTRICAL SUPPLY SYSTEM AND METHOD FOR IMPROVING THE OPERATING CHARACTERISTICS OF GASEOUS DISCHARGE DISPLAY PANELS

[75] Inventors: Joseph L. Miavecz; Donald J. Spry; David S. Wojcik, all of Toledo, Ohio

[73] Assignee: Owens-Illinois, Inc., Toledo, Ohio

[22] Filed: Feb. 23, 1972

[21] Appl. No.: 228,543

[52] U.S. Cl. ..... 315/169 TV; 315/169 R

[51] Int. Cl.[2] ..... H05B 37/00

[58] Field of Search ..... 331/113; 315/169, 169 TV; 313/220

[56] References Cited

UNITED STATES PATENTS

| | | | |
|---|---|---|---|
| 3,602,843 | 8/1971 | De Vries | 331/113 R |
| 3,614,769 | 10/1971 | Coleman | 315/169 TV |
| 3,626,241 | 12/1971 | Ngo | 315/169 |
| 3,651,509 | 3/1972 | Ngo | 315/169 TV |
| 3,654,388 | 4/1972 | Slottow | 315/169 TV |
| 3,689,912 | 12/1972 | Dick | 315/169 R |

*Primary Examiner*—R. V. Rolinec
*Assistant Examiner*—Lawrence J. Dahl
*Attorney, Agent, or Firm*—Donald Keith Wedding

[57] ABSTRACT

There is disclosed an electrical system and method for supplying operating potentials to gaseous discharge display panels and improving the performance characteristics of such devices. Write and erase operations are accomplished by means of controlling the level of pedestals which has the advantage over previous system in the improvement of sustaining and write/erase characteristics of gaseous discharge display/memory panels of the type disclosed in Baker et al. U.S. Pat. No. 3,499,167, which in turn produces a larger 100 percent operating window.

10 Claims, 6 Drawing Figures

$V_{PE} = V_{PW} = V_P$ (PRIOR ART)

ELECTRICAL SUPPLY SYSTEM AND METHOD FOR IMPROVING THE OPERATING CHARACTERISTICS OF GASEOUS DISCHARGE DISPLAY PANELS

BACKGROUND OF THE INVENTION

Gaseous discharge display/memory panels of the type to which the present invention pertains are disclosed in Baker et al. U.S. Pat. No. 3,499,167 and in the discussion which follows, the reference to a gaseous discharge display panel is to be had in connection with this type panel. However, another type of panel to which the invention is applicable is disclosed in Bitzer et al. U.S. Pat. No. 3,559,190. Panels are disclosed in these patents have an electrical memory constituted by the storage of charges produced on discharge on one or more dielectric surfaces in contact with the gas. Typically, the electrodes are non-conductively coupled to the gas and in the case of the Baker et al. patent the dielectric is a thin glass coating on each conductor array. The conductors are arrayed in columns and rows to form a cross conductor matrix between which an ionizable gaseous medium, typically a mixture of two gases at a selected pressure is confined in a thin gas chamber spaced therebetween. A preferred gas is a neon-argon gas mixtue as disclosed in Nolan application Ser. No. 764,577 filed Oct. 2, 1968. The dielectric layer permits the passage of any conductive current from the matrix conductor members to the gaseous medium and also serve as collecting surfaces for charges in the ionizable gaseous medium during alternate half-cycles of the periodic operating potentials applied thereto such potentials normally be designated as the sustainer potential.

The discharge condition of the gas between selected row-column conductor pairs is controlled by the application of discharge manipulating pulse potentials which are algebraically added to the sustainer potentials at selected times to initiate sequences of discharges sustainable by the sustainer potential and terminate the sequence of discharges by removal or termination of wall charging at the matrix cross points (see Johnson et al. U.S. Pat. No. 3,618,071).

In such panels there is a critical panel write voltage distribution and, in the same sense there is a critical erase voltage distribution. In accordance with the present invention, the write/erase pedestal voltages are adjusted so as to obtain the maximum operating range for a given display/memory panel. It is possible therefore to set the applied write voltage so that the critical half select voltages will be less than the minimum select voltage for the first firing of any site in the panel (as derived from the critical panel write voltage distribution) and the same applies with respect to the critical panel erase voltage distribution. By following teachings of this invention, the half select problem is minimized and a maximum write/erase window is obtained in addition to an overlap of the two for the operating range.

BRIEF DESCRIPTION OF THE DRAWINGS

The above and other objects, advantages and features of the invention will become more apparent in light of the following specification taken in conjunction with the accompanying drawings wherein:

In FIG. 1, a gaseous discharge display panel 10, preferably of the type disclosed in Baker et al. U.S. Pat. No. 3,499,167, filled with a neon-argon gas mixture (99.9 percent neon and 0.1 percent argon) as is disclosed in Nolan application Ser. No. 764,577 filed Oct. 2, 1968, and as further including a dielectric or insulative overcoating (not shown) on the dielectric coatings of the aforementioned Baker et al. patent, the overcoating being of a lead oxide composition as taught in Ernsthausen U.S. Pat. No. 3,634,719. Typically, the discharge gap in such panels is selected to be between 4 and 6 mills. The panel 10 is constituted by a row conductor plate 11 and a column conductor plate 12 joining in spaced apart relation by a spacer sealant (not shown) to provide the aforementioned discharge gap distance and a thin gas chamber in which the gaseous medium is placed under a suitable pressure.

The row conductor plate 11 carries row conductor array 13 and border conductor arrays (not shown) at the sites thereof. Column conductor plate 12 is identical to row conductor plate 11, having column conductor array 16 in the writing or viewing area of the data display area of the panel and border or side conductors (not shown).

Figure 1:
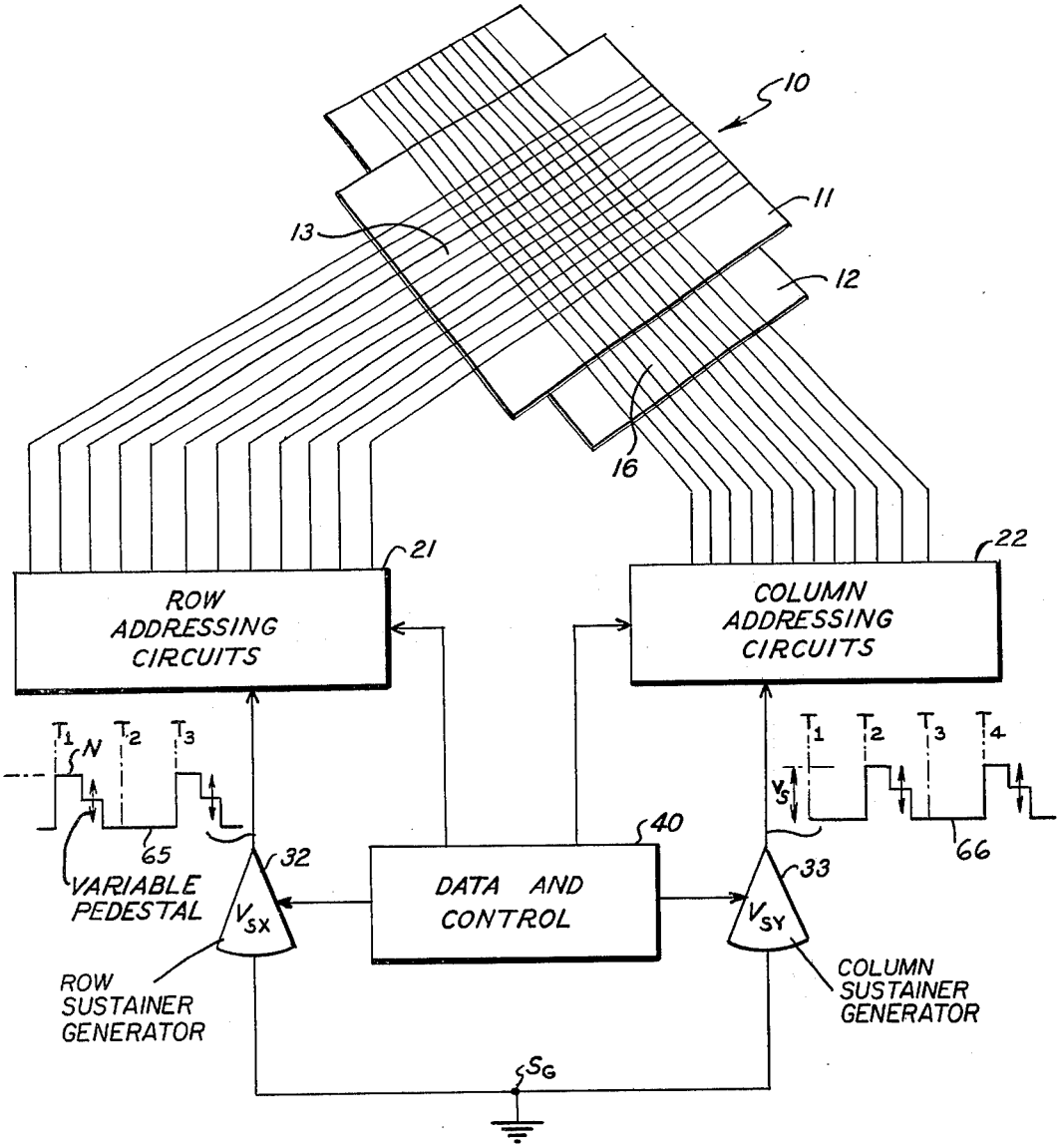
FIG. 1 is a block diagram of a preferred embodiment of the invention as applied to a gaseous discharge display panel, FIG. 2 are address waveforms as is in prior art addressing systems.

In a typical panel, the row conductors may be spaced very closely together as for example on 20 mil centers and, in like manner, the column conductors could be spaced on the same spacing or a differential in spacing may be used if desired. In FIG. 1, all the row conductors of an array are shown as served from the same side or edge of plate 11 but it will be apparent that due to the large numbers of conductors and being closely spaced on the plates, the conductors are preferably served from opposite ends in alternate fashion as is disclosed in Hoehn U.S. Pat. No. 3,631,287 including the angulation and grouping thereof if desired.

The addressing circuits 20 for the row conductors and the addressing circuits for 22 for the column conductors may be multiplexed resistor-diode addressing matrices or individual addressing or pulsing circuits for each row or column conductor. The multiplex matrix-type selection circuit is preferred, the objective of these circuits being to apply narrow pulse voltages, algebraically additive to the sustainer potentials, to individual conductors in the respective array, such conductor circuits being shown, for example, in Leuck application Ser. No. 135,621 filed Apr. 19, 1971 now U.S. Pat. No. 3,665,400. Such matrix circuits float upon their respective sustainer sources 32 and 33, respectively. It will be noted that the sustainer generators 32 and 33 have a common point of reference potential SG.

Row addressing circuits 21 and column addressing circuits 22 are controlled by signals from data source and control circuit 40 which also controls sustainer generators 32 and 33.

The above describes in general the environment or setting of the present invention which is concerned principally with a variable pedestal in the waveform of the sustainer voltage generator and the timing or location of the application to selective panel conductor of the discharge condition manipulating pulse potentials with respect to the pedestal. In FIG. 1 there is shown a waveform diagram 50 which is the output from sustainer generator 33 and a waveform diagram 51 which is the output from sustainer generator 32. These two waveform diagrams 50 and 51, when combined by the panel, constitute the sustainer voltage which is applied to the panel. These voltages are the same voltages as shown combined in FIG. 5 of the drawings. The portion of the waveform diagram labeled "pedestal" is at an adjustable level and the pulsing voltages applied by row pulsing row addressing circuitry 21 would be the voltage $V_{pw}$.

Figure 5:
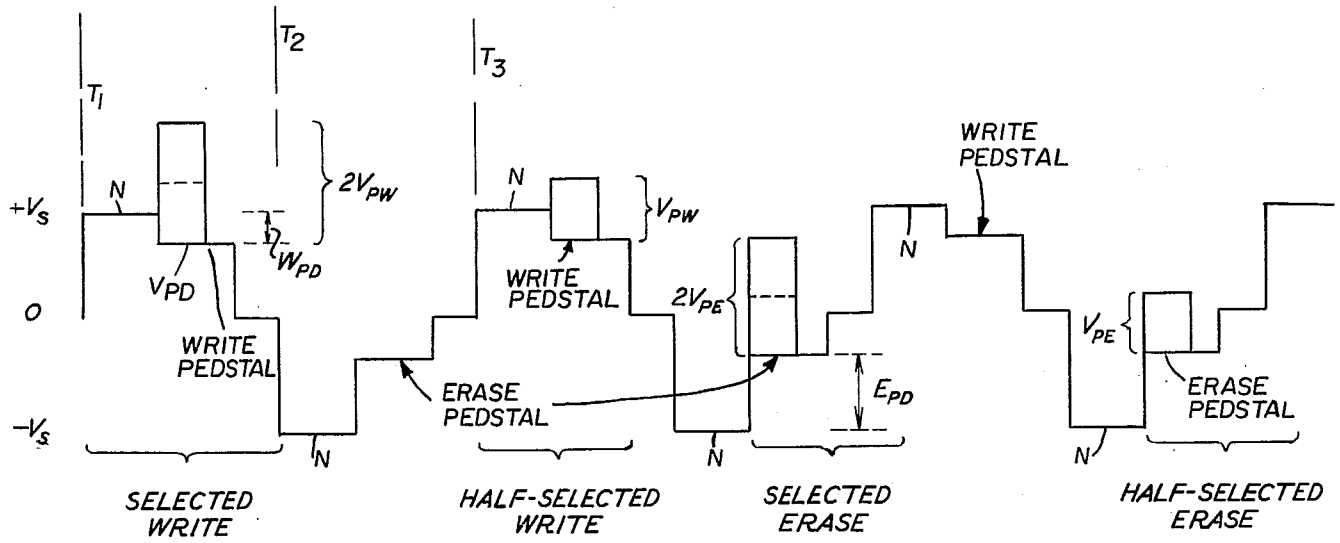
FIG. 5 illustrates the address waveforms for a pedestal address waveform.

Thus, as shown in waveform diagram in FIG. 5, the voltage indicated as $2V_{pw}$ is constituted by one voltage $V_{pw}$ from the row addressing circuits added on a selected conductor and a further voltage pulse of magnitude $V_{pw}$ which is applied at the same time interval to the opposite conductor in the array. The basic operating principle of this technique is to manually adjust the resistor values $R_1$ and $R_2$ on the Y-sustainer (FIG. 6) to obtain a desired write pedestal, and adjusting similar resistor combinations on the X-sustainer will result in an erase pedestal thus obtaining the maximum operating range for a given display/memory panel 10.

A selected write cell will have a critical panel voltage, $V_{cw} = V_s - W_{pd} + 2V_{pw}$, while a non-selected cell on that line will have the voltage of $V_{chsw} = +V_s - W_{pd} + V_{pw}$ as shown in FIG. 5. Accordingly, the selected erase cell will have the voltage $V_{ce} = -V_s + E_{pd} + 2V_{pe}$ and the non-selected erase cell of $V_{chse} = -V_s + E_{pd} + V_{pe}$.

Figure 3:
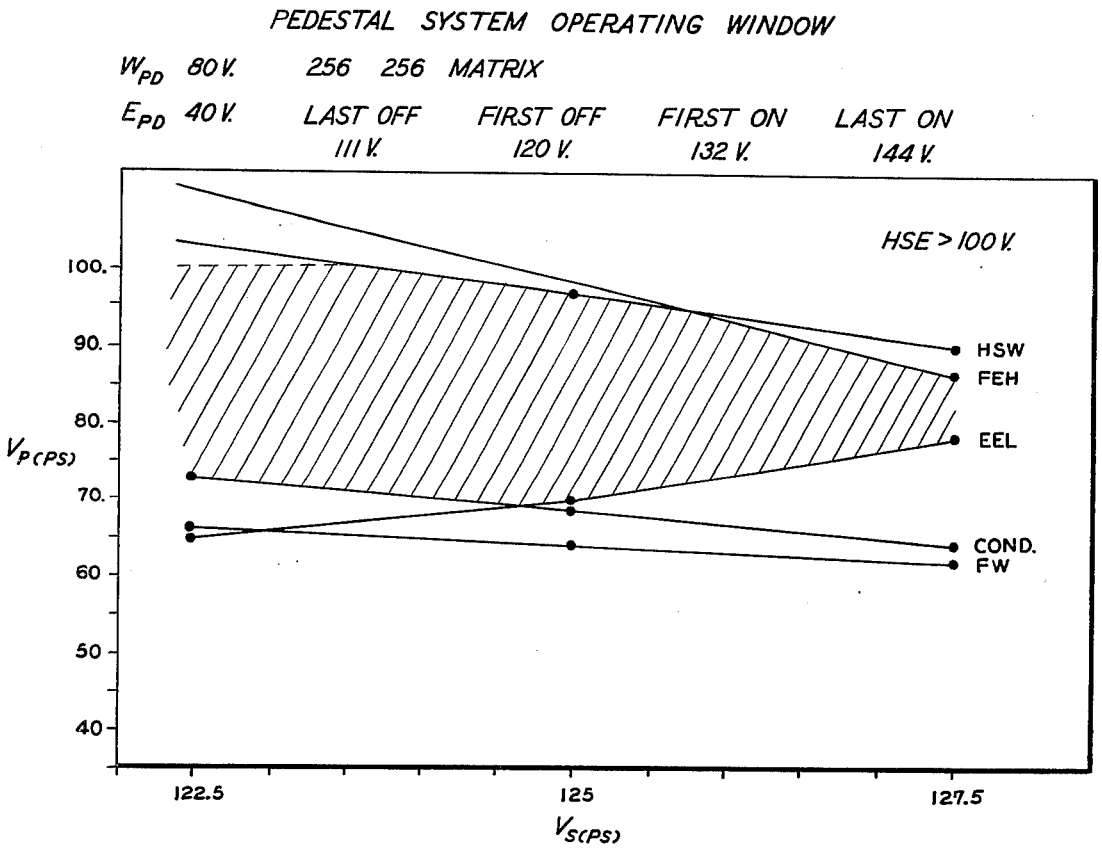
FIG. 3 illustrates the clamp pedestal sustainer system operating window.

The magnitude of $V_{pe} = V_{pw} = V_p$, adjusting the write/erase pedestals, has the effect of separate write/erase pulse magnitudes with the capability of achieving overlap in the write/erase windows as shown in FIG. 3. (the write window having the lower limit of FW [failure to write] and the upper limit of HSW [half-select write]. Similarly, the erase window has the lower limit of FEL [failure to erase low] and the upper limit of FEH [failure to erase high] or HSE [half-select erase], whichever occurs first.) The 100 percent operating window is the operating range over which all addressable sites in the panel turn on or off pursuant to adjusted level of write/erase pedestal.

Figure 4:
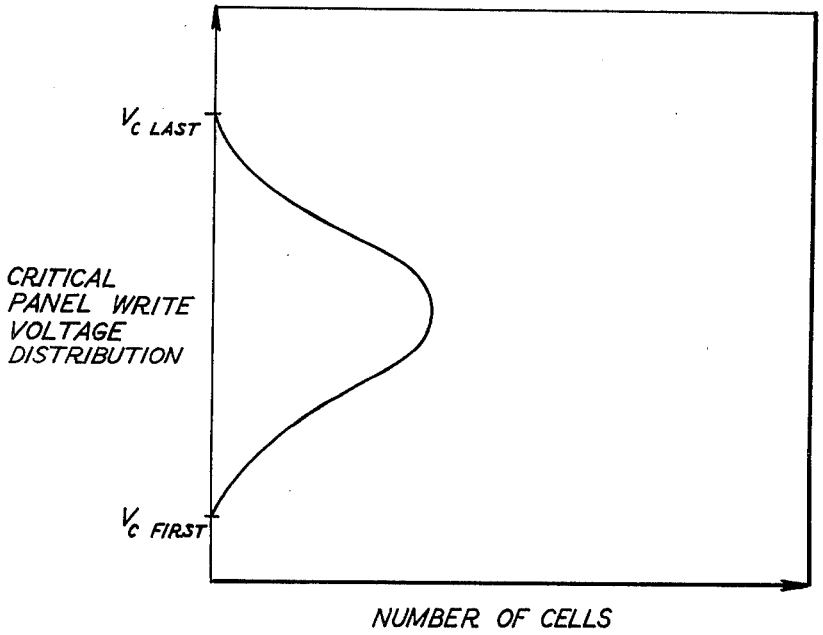
FIG. 4 illustrates the critical panel write voltage distribution of a selected panel.

From the critical panel write voltage distribution shown in FIG. 4, for a given display/memory panel, and assuming that these voltages are obtained with a constant $V_s$ and $W_{pd}$ but variable $V_{pw}$, it is possible to set $W_{pd}$ so that the critical half-select voltage will be less than the minimum selected voltage $V_c$ first, as shown in FIG. 4. In other words, if:

$$V_s - W_{pd} + V_{pw2} < V_s - W_{pd} + 2V_{pw1},$$

then the half-select problem will be minimized.

Figure 2:
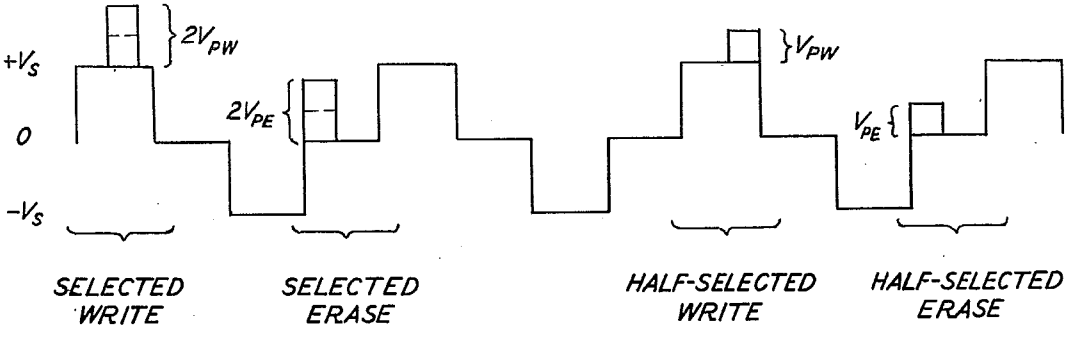

The same argument can be used for the critical erase voltage. FIG. 2 represents the address waveforms in the prior display system in which the present invention is an improvement. A quick examination shows that the critical write panel voltage is:

$$V_{cw} = V_s + 2V_{pw},$$

the critical half-select write voltage is:

$$V_{chsw} = V_s + V_{pw},$$

for the relationship:

$$V_{chsw} = V_s + V_{pw2} < V_s + 2V_{pw1}.$$

The above expression holds true through the range $V_{pw}$, which can be varied but is limited by the critical half-select voltage. Therefore, in the prior system of FIG. 2 the write/erase windows tend to be smaller when compared to the pedestal system of the present invention. A maximum write/erase window must be obtained, in addition to an overlap of the two for an operating range. The write/erase pedestals and pulse widths can be adjusted to obtain a larger operating range than with previous systems.

The use of pedestals makes the sustainer voltage pulses wider. Their use also improves the panel electrical characteristics.

The sustaining voltage generator may be of the type disclosed in the application of David S. Wojcik entitled "Baker Clamped Sustainer Voltage Generator for Pulsing Discharge Display Panel" filed Dec. 23, 1971 Ser. No. 210,864.

The Baker clamp generator illustrated for the "pull up" circuit is shown in detail and is constituted by a pair of pull up signal voltage pulses PU an PU NPN transistor Q1 has its collector connected through a collector resistor 50 to a low voltage control source and its emitter connected through resistor 51 to a low voltage ground. A separate signal PU is applied to the base of NPN transistor $Q_3$ which, in a similar fashion, has its collector connected through resistor 52 to a low voltage supply and its emitter connected through an emitter resistor 54 to a low voltage ground. The collector of transistor $Q_1$ is connected directly to the base of PNP transistor $Q_2$ which has its emitter connected through resistor 55 to the low voltage supply and its collector connected through the primary winding of transformer $T_1$ to the low voltage ground. Resistor 56 is connected in parallel with the primary winding of transformer $T_1$ so as to provide a controlled recovery therefor.

In a similar manner, an output is taken from the collector of transistor $Q_3$ and applied to the base of PNP transistor $Q_4$ which has its emitter connected through resistor 58 to the low voltage supply and its collector connected through the primary winding of transformer $T_2$ to the low voltage ground. Resistor 59 is connected in parallel with the primary winding of transformer $T_2$ to provide a controlled recovery therefor.

The lower end of the secondary winding of transformer $T_1$ is connected to a column point 70 at the lower end of the transformer secondary of transformer $T_2$ both of which are connected to the emitter electrode of transistor $Q_5$ which is the switching and load carrying transistor. However, the upper end of the secondary winding of transformer $T_2$ is connected through a diode $D_1$ to the base electrode of transistor $Q_5$ and, by way of Baker clamp diode $D_2$, to the collector electrode of transistor $Q_5$. The upper end of the secondary winding of transformer $T_1$ is connected through diode $D_3$ to the base electrode of transistor $Q_5$. A low value resistor is connected between the base and emitter electrodes of transistor $Q_5$ and a current loop 61 is connected to provide a measuring point for current flow to the collector of transistor $Q_5$ along with a heat sink (not shown). The collector of transistor $Q_5$ is then connected to the high voltage supply VCC (of about 150 volts) through diode $D_4$, which diode presents transistor $Q_5$ from turning on in an adverted mode. The bypass diode $D_5$ is for the purpose of providing a return path for charging currents to the panel when the generator on the opposite sides of the panel is reversed. If these diodes $D_5$, $D_4$ were not present, the charging of the panel or load could spike the transistor $Q_5$ on if this blocking and bypassing were not provided.

Diodes $D_1$ and $D_2$ clamp transistor $Q_5$ on and constitute in effect a modified Baker clamp circuit. Thus, these diode circuits render the switching of transistor $Q_5$ in a conductive state to avoid deep conduction or full saturation operation of this transistor. The rise and fall times of the square wave voltage generated at the output is thereby much sharper and a fast response to control signals is achieved thereby. Transistors $Q_1$ and $Q_2$, via transformer $T_1$, supply the high base current pulses to the transistor $Q_5$ which causes this transistor to saturate for the period in which the discharge takes place. Transistor $Q_3$ and $Q_4$, via transformer $T_2$, presents a drive to base of transistor $Q_5$, via diode $D_1$ that goes through the collectors if the device is saturated and tends to turn the transistor $Q_5$ off. Once this tends to happen, current is drawn through diodes $D_2$ and $D_1$ to supply only the base drive needed to keep transistor $Q_5$ just out of saturation but always capable of handling the current that might be called for the collector thereof. Diode $D_3$ is provided so as to present a high impedance to the secondary of transformer $T_2$ and thereby prevent the secondary of transformer $T_1$ from shorting the signal from transformer secondary $T_2$.

Figure 6:
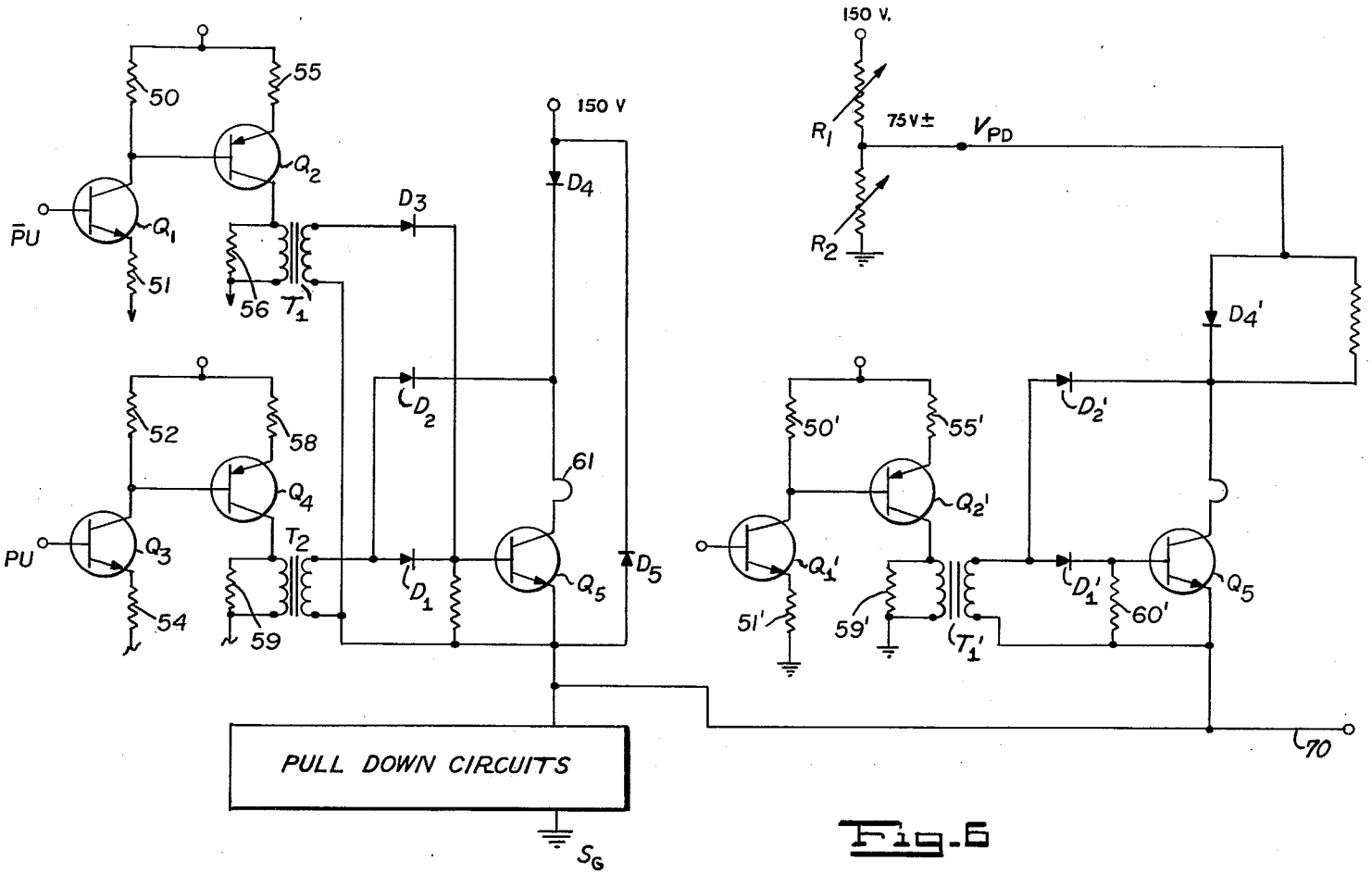
FIG. 6 illustrates a form of sustainer generator used in the invention.

The lower half of this circuit, e.g. the pull down half, labeled "pull down circuits" in FIG. 6, are constituted by circuits essentially identical to, and operated in a manner similar to the operation of the pull up circuits, except instead of being connected to a VCC supply, they are connected to point 36 e.g.c. panel conductors. The foregoing description of the operation of the Baker clamped sustainer generator circuit is essentially the same as given in the above identified Wojcik application Ser. No. 210,864.

Referring now to the pull up circuits constituted by transistor $Q_1'$, $Q_2'$ and $Q_3'$, and their associated diodes, this circuit is essentially the same in operation and identically to the same fashion as transistor $Q_1$, $Q_2$ and $Q_3$. "

The Baker clamped generator shown in the above reference Wojcik application may be used in the manner shown in FIG. 6 to supply the normal sustainer level $V_s$ and a second section identical to the upper level constituted by transistor $Q_1'$, $Q_2'$, $T_1'$, $D_1'$ and $D_2'$ connected to the supply voltage by means of a pair of resistors $R_1$ and $R_2$ or other variable impedance elements. These supply the vertical pulse pedestal voltages $V_{PD}$ which are approximately 75 volts plus or minus the adjusted level for achieving the maximum write-erase-windows.

In FIG. 5, the voltage increments shown as 2 $V_{PW}$ are generated by the row addressing circuits 21 and the column addressing circuits 22 and algebraically added, at the time coincidence shown, to the pedestal voltage $V_{PD}$. Thus, one of the voltage increments $V_{PW}$ shown on the first pedestal in FIG. 5 may be generated by the row addressing circuits and algabraically added to the pedestal voltage $V_{PD}$. That voltage is algabraically added to a second voltage $V_{PW}$ applied to a column conductor added to locate the selected crossing point. That voltage is algebraically added e.g. combined, with the voltage on the row conductor, the voltage on the row conductor being the sum of the voltage $V_{PD}$ and $V_{PW}$. Thus, the gaseous medium at the selected site has applied thereto by the row conductors the voltage $V_{PD}$ (the pedestal voltage) a half select write voltage $V_{PW}$ and the write voltage $V_{PW}$ on the column conductor located at selected sites. At the unselected sites, there will be the pedestal voltage $V_{PD}$ plus a half-select voltage $V_{PW}$.

For selectively erase operation, the same procedure of combining voltages on the pedestal level is effected, it being particularly noted that the pedestal voltage differential $V_{PD}$ is somewhat different (lower in amplitude) than the write pedestal voltage $W_{PD}$. In otherwords, it will be noted that the sustainer voltages pedestal used for the write is applied to the row conductor and the sustainer voltage for erase purposes as applied to the column conductors and are different. In this way, the maximum write-erase ratio is obtainable.

The primary advantage of this invention is the improvement in sustaining and write/erase characteristics, which, in turn, produces a larger operating window. In some panels this performance has increased by a factor of 5. Thus, the first portion of the sustainer voltage waveform which is labeled (for normal sustainer level) in FIG. 1 is consituted by the normal sustainer square wave output of a Baker clamped sustainer generator. The second voltage level portion labeled pedestal may be of lower amplitude than the $V_S$ level, by amount $W_{PD}$ (FIG. 5) and upon which the write voltages developed by the row addressing circuits 21 and the column addressing circuits 22 are algabraically added or combined. Thus, the voltage level $V_{PW}$ (there being two such voltage levels, one on the row conductor and one on the column conductor locating a selected discharge site) are algebraically added to constitute with the pedestal voltage $V_{PD}$ the write voltage. This pedestal voltage $V_{PD}$ is per se developed at voltage divider resistor $R_1$ and $R_2$ (FIG. 6) it will be noted that the differential voltage range $W_{PD}$ for the write pedestal and $E_{PD}$ for the erase pedestals are significantly different and that the erase voltages $V_{PE}$ are algebraically added in opposite directions to the pedestal for erase purposes. In the preferred embodiment disclosed herein, they are generated at the time shown by a separate sustainer section consituted by transistors $Q_1'$, $Q_2'$ and $Q_5'$ which apply the voltage $V_{PD}$ for the write section as developed across the voltage divider resistors, to the panel conductor line 70. Thus, the voltage wave form $V_5$, 66 as shown in FIG. 1 is constituted by two voltages generated by the sustainer generator shown to the left portion above the pull down circuits block and a second section to the right of the box labeled pulled down circuits by the primed transistor elements. The pull up circuits and pull down circuits disclosed herein as well as the data and control circuits are as disclosed in the above identified Wojcik application Ser. No. 210,864 filed Dec. 23, 1971. However, other sustainer voltage generators which are controlled in the same manner may be used which are manually adjusted at the level determined in accordance with principles of the invention described earlier herein. In other words, the level of this voltage or pedestal is adjusted in the range of $W_{pd}$ or $E_{pd}$ of FIG. 5 to obtain the maximum operating range for a given display memory panel 10. However, it should be noted that the adjustment or variation is limited by the critical half-select voltage.

Although the invention has been described in its preferred embodiment, it is clear that the basic principles thereof is applicable to other embodiments obvious to those skilled in the art and it is intended that the claims encompass such obvious embodiments.

What is claimed is:

1. In a gaseous discharge display panel having row-column conductor arrays nonconductively coupled to a gas discharge medium in a thin chamber space between said row and said column conductor arrays, improvement in the means supplying sustaining and write/erase voltage to said panel comprising, a sustainer generator for supplying to said panel a pair of contiguous square wave sustainer voltages, one of said voltages constituting a write/erase pedestal voltage, means to adjust the write/erase voltage pedestal voltage level to obtain the maximum operating range for said gaseous discharge display memory panel and, addressing circuit means connected to said sustainer generator for applying data entering discharge condition controlling signal voltage pulses for algebraic addition to said write/erase voltage pedestals.

2. The invention defined in claim 1 said means to adjust including means to establish a selected write voltage level and means to establish a selected erase voltage level.

3. The invention defined in claim 1 wherein said write/erase pedestal level is below the amplitude level of the other of said pair of contiguous square wave sustainer voltages and both said levels being below the level for firing any site in said panel.

4. In a gas discharge display panel having a pair of crossed conductor arrays non-conductively coupled to a thin gas discharge medium to which are applied a periodic sustaining voltage and discharge condition manipulating write and erase pulse voltages, the improvement comprising means for supplying a write/erase pedestal sustainer voltage to all conductors of said arrays in addition to said periodic sustaining voltage, means for adjusting the level of said pedestal sustainer voltage in accordance with the critical panel write voltages, and means, for adjusting the level of said pedestal sustainer voltage in accordance with the critical panel erase voltages.

5. A method of operating a gas discharge data display panel of the type having an insulatingly coated row-conductor array, an insulatingly coated column conductor array means mounting said arrays in spaced apart relation with a gaseous discharge medium therebetween, and wherein the operating potentials to said conductor arrays includes a periodic voltage for sustaining discharges once initiated, said periodic sustainer voltage being of a magnitude insufficient to initiate a discharge at any site but of sufficient magnitude to maintain discharges once initiated at any site, and a data entering discharge initiating signal voltage for algebraic addition to said sustainer voltage potential, the improvement comprising, supplying sustainer potential to said conductors, said sustainer potential having at least two amplitude levels, one of which is fixed and the other of which is variable and at a level below the said one at a fixed level, both said levels being below the level for firing any site in said panel, and causing said data entering signals to occur during selected times of occurrences of said variable level.

6. The invention defined in claim 5 including adjusting the level of said variable level in accordance with the critical voltage characteristics of said panel to produce a larger 100 percent operating window.

7. The invention defined in claim 5 including maintaining the voltage level of said second sustainer level during writing of information to said panel.

8. The invention defined in claim 5 including maintaining the voltage level of said second level during erase of information to said panel.

9. The invention defined in claim 5 wherein said variable voltage level is different for writing information to said panel than for erasing information from said panel.

10. In a gas discharge display device having a first conductor array and a second conductor array, each conductor array being non-conductively coupled to a thin gaseous discharge medium and to which are alternately applied periodic sustaining voltages from a source, and discharge condition manipulating write and erase pulse voltages, the improvement wherein said source of alternately applied periodic sustaining voltage includes first sustaining voltage means supplying a first voltage having two amplitude levels and applying same to said first conductor array, addressing circuit means causing said write voltage pulses to be algebraically added to the lower of said two amplitude levels, and second sustaining voltage operating alternately with respect said first means, supplying a second voltage having two amplitude levels and applying same to said second conductor array, and second addressing circuit means causing said erase voltage pulses to be algebraically added to the lower of said two amplitude levels in said second voltage.

* * * * *